US006354462B1

(12) United States Patent
Conran et al.

(10) Patent No.: US 6,354,462 B1
(45) Date of Patent: Mar. 12, 2002

(54) PAPER DISPENSER CONTAINING A REMOVABLE CASE

(75) Inventors: Sébastian Conran; Joseph Patrick O'Connor, both of London (GB); Jean-Louis Neveu, Colmar (FR); Bernard Louis Dit Picard, Amfreville la Campagne (FR); Yves Malecot, Crosville la Vieille (FR)

(73) Assignee: Georgia-Pacific S.a.r.l., Luxembourg (LU)

( * ) Notice: Subject to any disclaimer, the term of this patent is extended or adjusted under 35 U.S.C. 154(b) by 0 days.

(21) Appl. No.: 09/214,783

(22) PCT Filed: Jul. 11, 1997

(86) PCT No.: PCT/FR97/01302

§ 371 Date: Mar. 15, 1999

§ 102(e) Date: Mar. 15, 1999

(87) PCT Pub. No.: WO98/02078

PCT Pub. Date: Jan. 22, 1998

(30) Foreign Application Priority Data

Jul. 12, 1996 (FR) ..... 96 08765

(51) Int. Cl.[7] ..... A47K 10/24; B65H 1/00

(52) U.S. Cl. ..... 221/45; 221/46; 221/48; 221/63; 221/197

(58) Field of Search ..... 221/45, 46, 49, 221/57, 62, 63

(56) References Cited

U.S. PATENT DOCUMENTS

| | | | | | |
|---|---|---|---|---|---|
| 2,884,162 | A | * | 4/1959 | Crebbs | 221/46 |
| 3,245,580 | A | * | 4/1966 | Campanella | 221/46 X |
| 3,295,717 | A | * | 1/1967 | Gantner | 221/46 |
| 3,343,716 | A | * | 9/1967 | Peebles | 221/46 |
| 4,411,374 | A | * | 10/1983 | Hotchkiss | 221/46 X |
| 4,562,938 | A | * | 1/1986 | Loder | 221/46 |
| 4,586,629 | A | * | 5/1986 | Loder | 221/46 |
| 5,462,197 | A | * | 10/1995 | Pound | 221/46 |
| 5,927,488 | A | * | 7/1999 | Gray | 221/46 X |
| 5,950,863 | A | * | 9/1999 | Schutz et al. | 221/46 X |

* cited by examiner

*Primary Examiner*—Christopher P. Ellis
*Assistant Examiner*—Gene O. Crawford
(74) *Attorney, Agent, or Firm*—Breiner & Breiner, L.L.C.

(57) ABSTRACT

The invention proposes a dispenser of paper, or other equivalent product, including a housing storing the product in the form of folded sheets to be dispensed through a dispensing opening. The paper is contained in a detachable cartridge compatible with the paper dimensions and assembled to the dispenser inside the housing. The cartridge includes an end wall situated opposite an opening of the housing wherein is located a dispensing slot of which the shape matches the paper sheets to be dispensed. The cartridge includes walls which guide the stack of folded sheets.

12 Claims, 3 Drawing Sheets

PAPER DISPENSER CONTAINING A REMOVABLE CASE

The invention relates to a dispenser of paper or other flexible products in sheet form, such as non-woven or dry-made products, the dispenser including a removable cartridge.

More specifically, the invention concerns a paper dispenser having a housing storing the paper in the form of folded sheets to dispense the paper through a dispensing orifice.

Many products presently are available in the form of individual, folded and stacked sheets ready for dispensing. This is especially the case for paper towels.

However, a product of a given type may be offered in different sizes or may be made of papers of different kinds and, in particular, of different thicknesses depending on the dispenser location and also depending on the habits of the anticipated users.

Proper paper dispenser operation requires appropriately storing and guiding the paper sheets inside the dispenser.

Moreover, the paper dispensing orifice, which generally is a slot at the base of the housing, must match the format of the paper sheets, the manner in which they are folded, and the actual kind of paper.

Heretofore it has been necessary either to design a housing dedicated to each type of dispensed product or to make do with a "universal" housing which, in many cases, is less than wholly satisfactory, often causing cramming and interference with paper dispensing or, on the contrary, allowing simultaneous dispensing of several sheets.

In order to offer a simple, reliable and economic solution to the above problems, the invention proposes a dispenser of the above species which is characterized in that the paper is contained in a cartridge mounted in the housing and in that the cartridge includes a base wall situated opposite a housing aperture, the base wall including a dispensing opening of a shape matching the paper sheets to be dispensed, and in that the cartridge includes guide walls for the stack of folded sheets.

In other features of the invention:

- the cartridge is open at its top to allow loading it with paper,
- the cartridge is kept elastically nested inside the housing,
- the housing includes a detachable cover allowing insertion of the cartridge into the housing,
- the cartridge is made at least in part of molded plastic,
- the cartridge is integrally made of molded plastic,
- the cartridge is integrated into a stack of paper sheets,
- the cartridge is made at least in part of cardboard.

Furthermore, the invention also offers a cartridge for a folded sheets dispenser, characterized in that the cartridge is mounted in a dispenser having any one of the above features.

Other features and advantages of the invention are elucidated below in the comprehensive description made in relation to the attached drawings.

Figure 1:
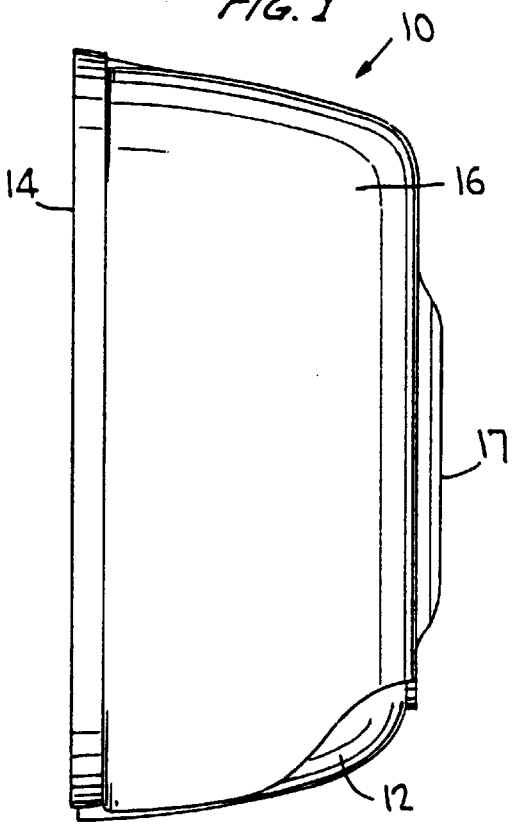
FIGS. 1 and 2 are external views, respectively side and front views, of a wall-mounted paper sheet dispenser of the invention.
Figure 2:
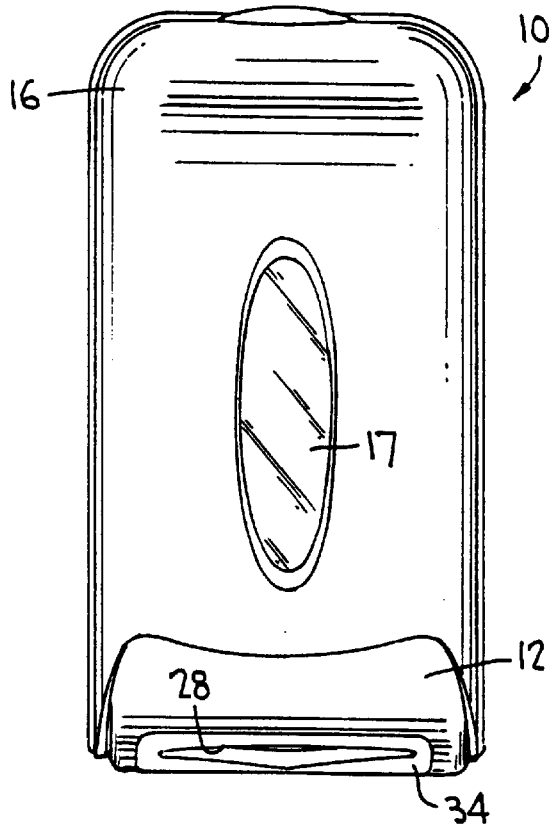
Figure 3:
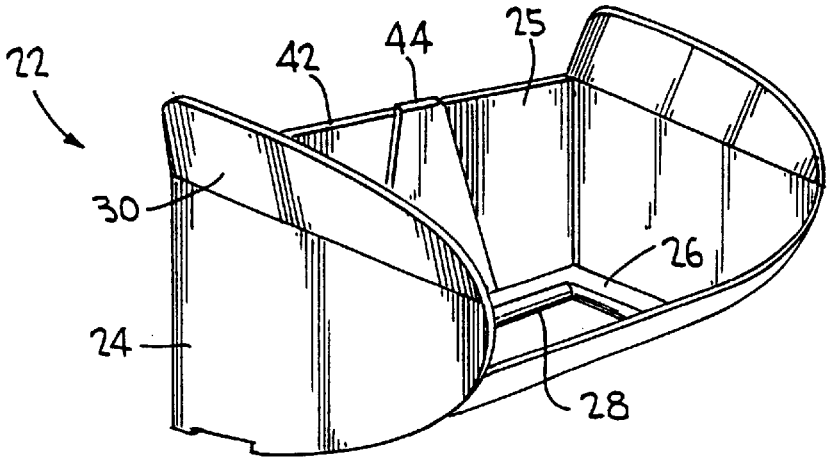
FIG. 3 is a perspective on a larger scale of a cartridge of the invention.

The Figures show a paper dispenser 10 basically including a housing 12 to be affixed by a planar, rear vertical side 14 against a vertical building wall.

The housing 12 includes a cover 16 which covers the housing almost entirely and which allows, when removed or open, access to the inside of the housing 12. The inside of the cover 18 includes a window 17 to continuously check that the dispenser 10 is filled.

In this manner, the dispenser 10 can be filled with a pack of individual, folded and stacked sheets F to be dispensed through an opening 18 in a lower end wall 20 of the housing 12.

In a particular embodiment and in a known manner, the paper sheets F are folded and stacked in such a way that when the user seizes one sheet, the following one, slightly unfolded, appears at the level of the opening 18, outside the housing 12, to be easily seized by the user.

Besides the necessity of rigorous folding, and to assure that dispensing takes place under good conditions, the position of the paper stack in the housing must be well controlled and, in particular, it must be monitored to stay vertical in order to apply uniform pressure on the set of sheets, the lower sheets being those to be dispensed first.

The dimensions and the shape of the orifice through which the sheets are dispensed are highly significant to smooth dispensing.

Accordingly, the invention proposes a dispenser 10 wherein the housing 12 receives a cartridge 22 mounted inside the housing 12 and particularly matching the paper sheets F to be dispensed.

The Figures show such a cartridge 22 which in particular includes two side walls 24 and one vertical rear wall 25 which bound a seat accurately matching the size of the paper sheets F to be stacked.

For that purpose, the two side walls 24 are moved apart from each other by a distance corresponding to the size of the paper sheets F in this direction.

The cartridge 22 is received in a lower portion of the housing 12 to rest against the lower end wall 20 of the housing 12. In turn, the cartridge 22 includes a lower end wall 26 supporting the paper sheets F and including a dispensing slot 28 which is situated opposite the opening 18 of the end wall 20 of the housing 12. The dispensing slot 28 is substantially rectangular and its size matches the sheets' format and also includes rounded edges to avert tearing the paper at the time of dispensing.

Figure 4:
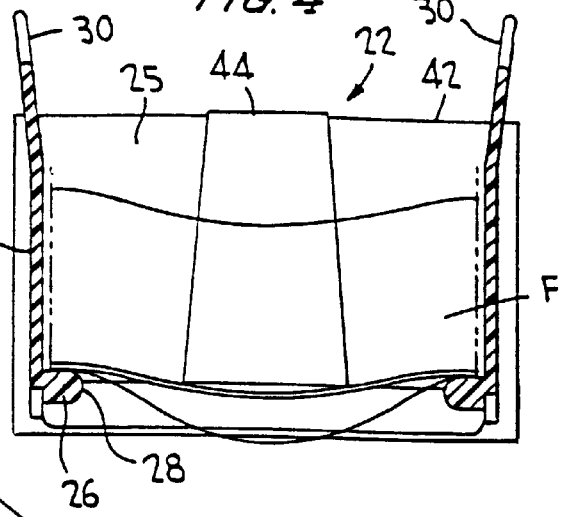
FIG. 4 is a partial sectional view in a vertical plane illustrating the installation of the cartridge in the housing.
Figure 5:
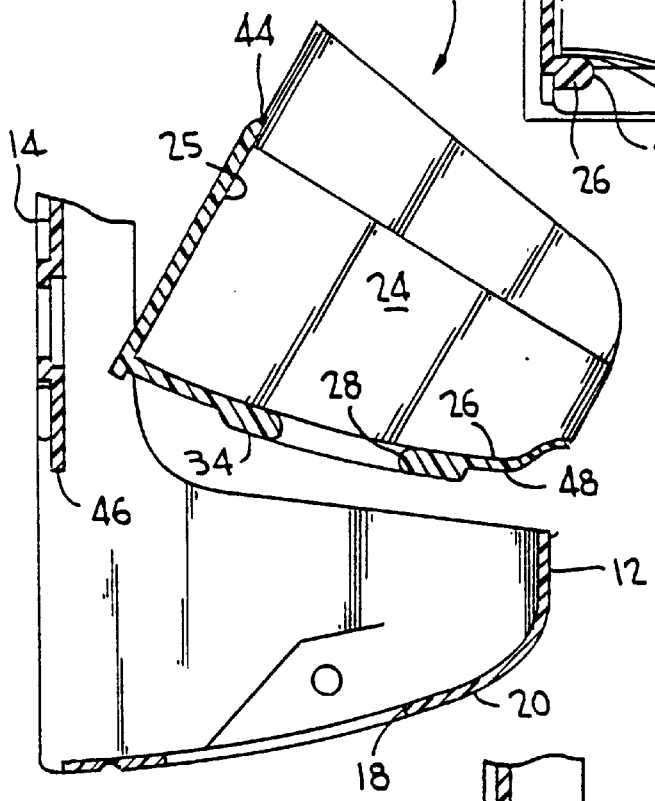
FIGS. 5–8 are partial sectional views in a lateral vertical plane illustrating various cartridge installation stages in the housing.
Figure 6:
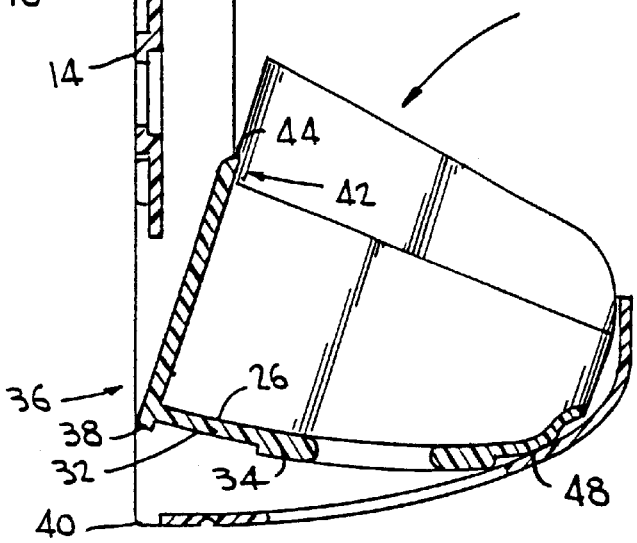
Figure 7:
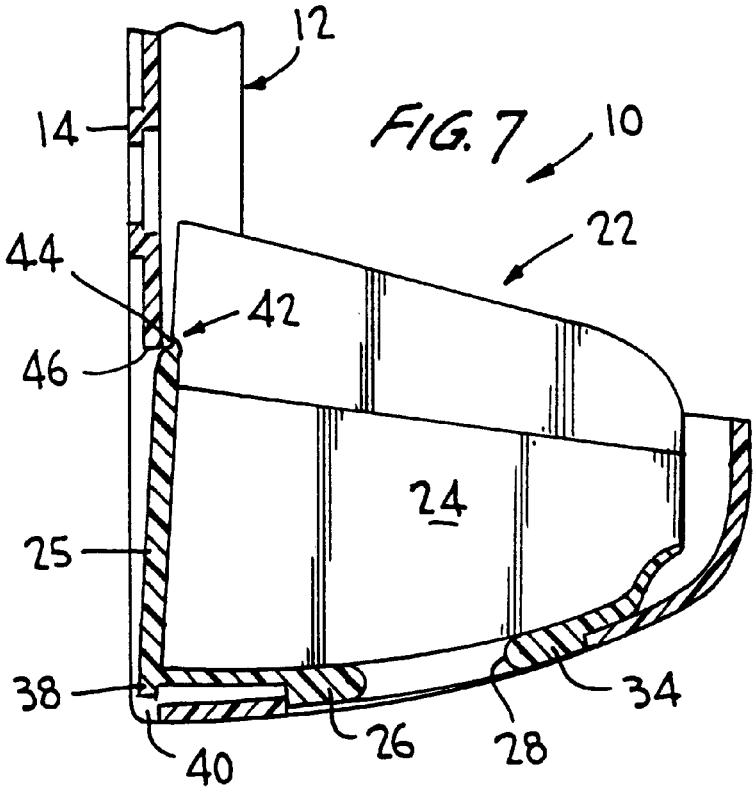
Figure 8:
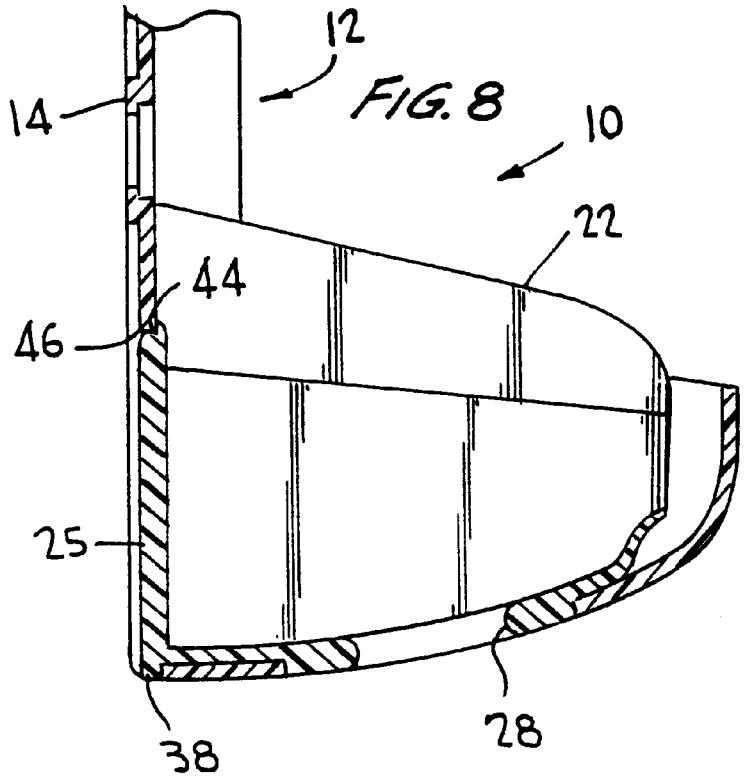
Figure 9:
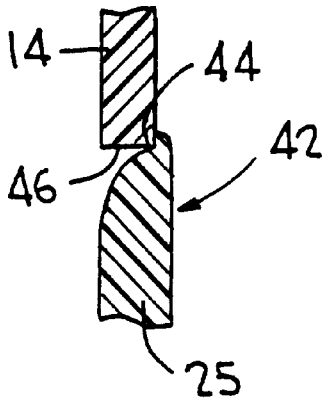
FIG. 9 is an enlarged detail view of FIG. 8 showing means affixing the cartridge in the housing.

As shown more particularly in FIG. 4, the vertical side walls 24 of the cartridge 22 include a flaring upper portion forming a hopper to facilitate reloading the cartridge with a new stack of paper sheets F.

To further facilitate reloading, the cartridge 22 practically lacks a front side. This lack does not degrade guidance because the lower end wall 26 of the cartridge 22 supporting the paper sheets is slightly sloping rearward whereby the stack of paper to be dispensed tends to press against the inside surface of the rear wall 25 of the cartridge 22. This configuration moreover makes it easier to put the stack in place.

Advantageously, the cartridge 22 of the invention is inserted and kept in place inside the housing by a simple elastic nesting means.

For that purpose, the lower wall 26 of the cartridge 22 includes at its outer surface 32 a boss 34 of which the shape is complementary to that of the opening 18 of the lower wall 20 of the housing 12 in which the boss 34 is received to center the cartridge 22. Necessarily, the dispensing slot 28 of the cartridge 22 is present inwardly of the boss 34 so as to issue outside the dispenser 10.

The rear wall 26 of the cartridge 22 includes at its lower edge 36 a projection 38 running substantially vertically downward below the lower end wall 26 and the projection is received in an aperture 40 of the housing 12.

On the other hand, the upper edge 42 of the rear wall 25 includes a catch 44 which cooperates with a complementary edge 46 of the rear wall 14 of the housing 12 to keep the cartridge 22 in an elastically nesting manner when the cartridge is inserted into the dispenser 12, its lower end wall 26 resting against the lower end wall 20 of the housing 12.

As shown in FIGS. 5 through 8, the cartridge 22 is easily installed in the dispenser 12 by inserting the cartridge 22 vertically from top to bottom inside the housing 12 from which the cover 16 was previously removed.

At the front of its lower end wall 26, the cartridge 22 includes an edge 48 that is made to rest against the inside surface of the end wall 20 of the housing 12 and about which then it is enough to pivot the cartridge 22 rearward. The boss 34 and the rear projection 38 consequently move opposite the opening 18 and the aperture 40 of the housing 12 and, by continuing the pivoting motion, the catch 44 of the upper edge 42 of the rear wall 25 of the cartridge 22 automatically locks itself underneath the lower edge 46 of the rear surface 14 of the housing 12.

The cartridge 22 shown in the Figures is used to dispense relative large format sheets of paper, substantially the maximum format that the housing 12 can accept.

In case smaller format paper sheets must be dispensed using the same dispenser 10, necessarily another (not shown) cartridge of which the side walls 24, 25 are nearer to each other must be put into the housing 12. Also the shape of the dispensing slot 28 may be different.

In all cases, the external shape of the cartridge 22 matches exactly that of the housing 12 in such a manner that once the cartridge is in place inside the housing 12, it is kept in place therein rigidly and reliably without resort to complementary retaining means.

The cartridge 22 shown in the FIGS. is made of molded plastic and intended for reloading. After the dispenser has been installed in a particular place, it may be desirable to dispense only a single type of paper sheets, whereby the cartridge 22 can be permanently installed into the housing 12. In such a case, the cartridge 22, illustratively, can be permanently in place without disassembling the dispenser 10 from the building wall to which it is affixed.

In this embodiment mode, the cartridge 22 is integral and, accordingly, the dispenser 10 of the invention is of a very low number of parts and thus can be manufactured simply and economically.

However, the cartridge 22 also can be designed to be disposable and be an integral part of the packaging of the products to be dispensed.

In such a case, the cartridge 22 can be designed at a lower cost, for example only the affixation means constituted by the boss 34 and the rear wall 25 need be made of plastic, the remainder being made of a cheaper material such as cardboard.

In such a case, the cartridge 22 can constitute only the lower part of the packaging of a stack of sheets F, the packaging then being in the form of a cardboard box or of a plastic film affixed to the cartridge and surrounding the stack of sheets F.

Such a device is especially advantageous due to assuring that proper positioning of the stack of papers already is implemented at the factory and thereby is optimal relative to the dispensing slot and to the stack's guide walls.

Also, reloading is especially made easy in such an embodiment.

What is claimed is:

1. A paper dispenser comprising a housing for holding paper as a stack of folded sheets, the housing being constructed and arranged for mounting on a vertical surface; a cartridge for supporting the paper and having dimensions compatible with dimensions of the paper; wherein the cartridge is removably affixed inside a lower portion of the housing and rests against a bottom wall of the housing, the bottom wall containing an opening therein; wherein the cartridge includes a lower end wall with a dispensing slot therein which corresponds to said opening in the bottom wall of the housing; wherein the cartridge has a shape matching that of the folded sheets; wherein the cartridge has two vertical side walls with each having a flaring upper portion forming a hopper to facilitate reloading of the cartridge with a stack of folded sheets; and wherein the cartridge is constructed and arranged to elastically nest inside the dispenser housing.

2. Dispenser as claimed in claim 1 wherein the cartridge has an open top to allow loading of the paper in the cartridge.

3. Dispenser as claimed in claim 1 wherein the housing further comprises a cover which is removably attached to the housing to allow insertion of the cartridge in the housing.

4. Dispenser as claimed in claim 1 wherein the cartridge is made of molded plastic.

5. Dispenser as claimed in claim 1 wherein the cartridge is made at least partially of cardboard.

6. Dispenser as claimed in claim 1 wherein the cartridge is made at least partially of plastic.

7. Dispenser as claimed in claim 6 wherein the cartridge is made at least partially of cardboard.

8. Dispenser as claimed in claim 1 wherein the cartridge is provided as a unit with the stack of folded sheets.

9. Dispenser as claimed in claim 8 wherein the cartridge is made at least partially of cardboard.

10. A cartridge for supporting and dispensing folded paper sheets from a stack and having dimensions compatible with the sheets, comprising a lower end wall including a dispensing slot having a shape to match that of the sheets and two vertical side walls with each having a flaring upper portion forming a hopper to facilitate reloading of the cartridge, the cartridge being removably affixable in a lower portion of a dispenser housing constructed and arranged for mounting on a vertical surface; and wherein the cartridge is constructed and arranged to elastically nest inside the dispenser housing.

11. The cartridge of claim 10, wherein the cartridge has an open top to allow loading of the folded paper sheets into the cartridge.

12. The cartridge of claim 10, wherein the cartridge is provided as a unit with a stack of the folded paper sheets.

* * * * *